US007355375B2

(12) United States Patent
Xi

(10) Patent No.: US 7,355,375 B2
(45) Date of Patent: Apr. 8, 2008

(54) DYNAMIC BIAS CIRCUIT FOR USE WITH A STACKED DEVICE ARRANGEMENT

(75) Inventor: Xiaoyu Xi, Plano, TX (US)

(73) Assignee: NXP B.V., Eindhoven (NL)

( * ) Notice: Subject to any disclaimer, the term of this patent is extended or adjusted under 35 U.S.C. 154(b) by 361 days.

(21) Appl. No.: 11/241,285

(22) Filed: Sep. 30, 2005

(65) Prior Publication Data

US 2007/0075693 A1 Apr. 5, 2007

(51) Int. Cl.
*G05F 1/40* (2006.01)
*G05F 1/56* (2006.01)

(52) U.S. Cl. ..... 323/282; 323/271

(58) Field of Classification Search ..... 323/265, 323/268, 270, 271, 273, 275, 279, 282, 285, 323/299, 303
See application file for complete search history.

(56) References Cited

U.S. PATENT DOCUMENTS 6,836,148 B2 12/2004 Pullen
6,873,503 B2 * 3/2005 Amick et al. ..... 361/18
6,894,565 B1 * 5/2005 Bocock et al. ..... 330/285
7,102,336 B2 * 9/2006 Adachi ..... 323/276
7,242,252 B2 * 7/2007 Taylor ..... 330/296

* cited by examiner

*Primary Examiner*—Matthew V. Nguyen
(74) *Attorney, Agent, or Firm*—Peter Zawilski

(57) ABSTRACT

A regulator circuit includes a first transistor coupled to a supply voltage and a second transistor coupled between the first transistor and an output node. The regulator circuit also includes a dynamic bias circuit that may selectively provide a bias voltage to a gate of the second transistor. During a first mode such as a low power mode, for example, the bias circuit may provide the bias voltage at a fixed percentage of the supply voltage as the supply voltage varies. In addition, during a second mode such as a high power mode, for example, the bias circuit may provide the bias voltage at a fixed offset from the supply voltage as the supply voltage varies.

30 Claims, 3 Drawing Sheets

DYNAMIC BIAS CIRCUIT FOR USE WITH A STACKED DEVICE ARRANGEMENT

BACKGROUND OF THE INVENTION

1. Field of the Invention

This invention relates to regulator circuits and, more particularly, to biasing of stacked power transistor devices within the regulator circuits.

2. Description of the Related Art

As complimentary metal oxide semiconductor (CMOS) device technology continues to advance, the device feature sizes continue to get smaller and the oxides continue to get thinner. These devices may be more susceptible to damage due to over voltage stressing. Accordingly, to prevent over-stressing of these devices, they are typically used in applications with a reduced supply voltage. For example, devices manufactured using a typical 0.35 u CMOS process may only handle a supply voltage of approximately 3.3V. However, in many mobile devices such as mobile telephones, personal digital assistants (PDA), and the like, the typical battery voltage may range from 3.0V to 5.5V. Thus to directly use the battery voltage as a supply, designers are sometimes faced with either using devices manufactured with a high-voltage compatible process or to design the circuit to protect the low voltage devices from the high-voltage rail.

SUMMARY

Various embodiments of a dynamic bias circuit for use with a stacked device arrangement are disclosed. In one embodiment, a regulator circuit includes a first transistor coupled to a supply voltage and a second transistor coupled between the first transistor and an output node. The regulator circuit also includes a bias circuit that may selectively provide a bias voltage to a gate of the second transistor. The bias circuit may provide the bias voltage at a fixed percentage of the supply voltage as the supply voltage varies during a first mode such as a low power mode, for example. In addition, the bias circuit may provide the bias voltage at a fixed offset from the supply voltage during a second mode such as a high power mode, for example.

In one implementation, the bias circuit includes a voltage divider formed from a first resistor coupled to a second resistor between the supply voltage and a reference node, such as circuit ground for example. The output node of the bias circuit is the node between the first and second resistors. The bias circuit further includes a third resistor coupled in series to an independent current source. One terminal of the third resistor is coupled to the supply voltage and one terminal of the independent current source is coupled to the reference node. In addition, the node between the third resistor and the independent current source is coupled to the output node.

In another implementation, the bias circuit may provide the bias voltage at the fixed offset from the supply voltage in response to the independent current source being enabled by an enable signal. However, the bias circuit may provide the bias voltage at a fixed percentage of the supply voltage in response to the independent current source being disabled by an enable signal.

In yet another implementation, the independent current source may provide a reference current dependent upon a bandgap reference voltage.

Figure 1:
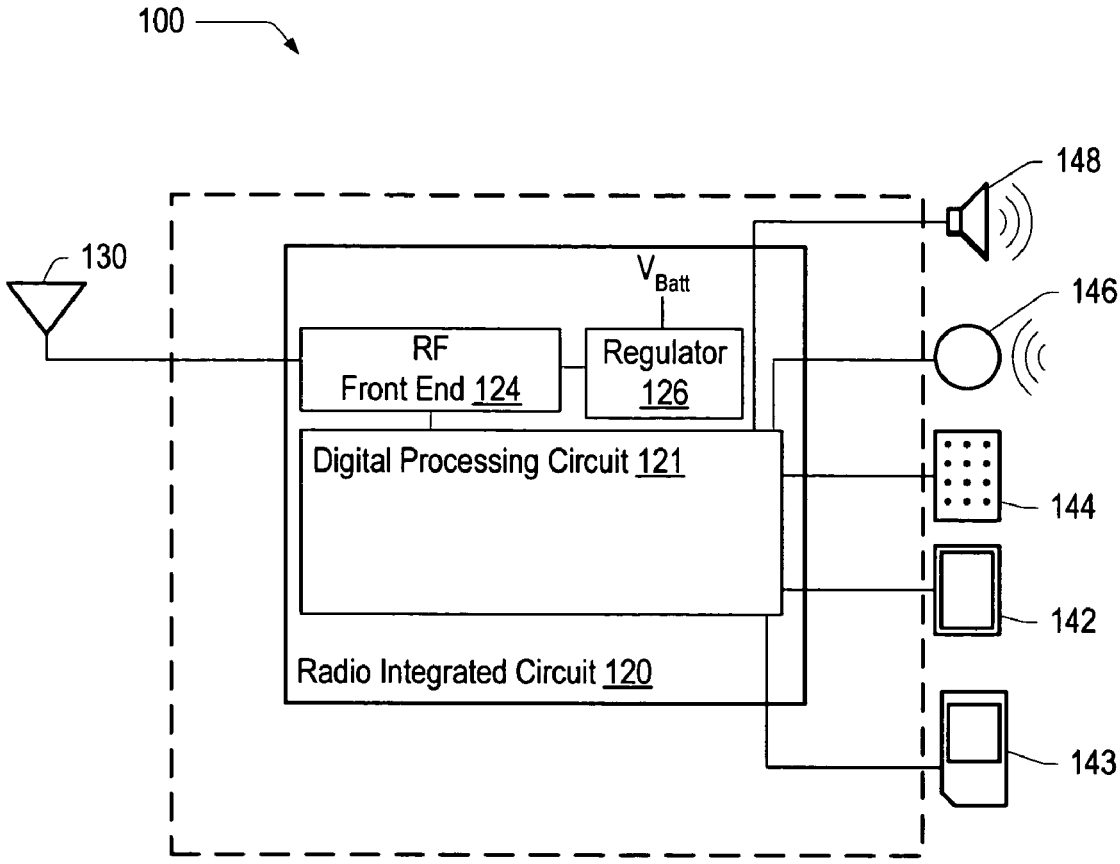
FIG. 1 is a block diagram of one embodiment of a wireless communications apparatus.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents, and alternatives falling within the spirit and scope of the present invention as defined by the appended claims. Note, the headings are for organizational purposes only and are not meant to be used to limit or interpret the description or claims.

DETAILED DESCRIPTION

Turning now to FIG. 1, a block diagram of one embodiment of a wireless communications apparatus is shown. Communication apparatus 100 includes a radio integrated circuit 120 that is coupled to an antenna 130.

In the illustrated embodiment, the radio integrated circuit 120 includes an RF front-end circuit 124 that is coupled to a regulator circuit 126 and to a digital processing circuit 121. As shown, various user interfaces including a display 142, an authentication device 143, a keypad 144, a microphone 146, and a speaker 148 are coupled to digital processing circuit 121. However, depending upon the specific application of communication apparatus 100, other types of user interfaces may be used. As such, it is noted that in various embodiments, communication apparatus 100 may include additional components and/or couplings not shown in FIG. 1 and/or exclude one or more of the illustrated components, depending on the desired functionality.

Communication apparatus 100 is illustrative of various wireless devices including, for example, mobile and cellular phone handsets, machine-to-machine (M2M) communication networks (e.g., wireless communications for vending machines), so-called "911 phones" (a mobile handset configured for calling the 911 emergency response service), as well as devices employed in emerging applications such as 3G, satellite communications, and the like. As such, wireless communication apparatus 100 may provide RF reception functionality, RF transmission functionality, or both (i.e., RF transceiver functionality).

Communication apparatus 100 may be configured to implement one or more specific communication protocols or standards, as desired. For example, in various embodiments communication apparatus 100 may employ a time-division multiple access (TDMA) standard or a code division multiple access (CDMA) standard to implement a standard such as the Global System for Mobile Communications (GSM) standard, the Personal Communications Service (PCS) standard, and the Digital Cellular System (DCS) standard. In addition, many data transfer standards that work cooperatively with the GSM technology platform may also be supported. For example, communication apparatus 100 may also implement the General Packet Radio Service (GPRS) standard, the Enhanced Data for GSM Evolution (EDGE)

standard, which may include Enhanced General Packet Radio Service standard (E-GPRS) and Enhanced Circuit Switched Data (ESCD), and the high speed circuit switched data (HSCSD) standard, among others.

In the illustrated embodiment, radio integrated circuit 120 may be a single integrated circuit that may be thought of as a radio on a chip. More particularly, in one embodiment radio integrated circuit 120 may embody many, if not all, of the components typically employed in a radio communications device. However, in some embodiments, various discreet components (not shown) used for RF filtering and antenna coupling which may not be suitable for inclusion within radio integrated circuit 120 may be external to radio integrated circuit 120.

RF front-end circuit 124 may include circuitry to provide the RF reception capability and/or RF transmission capability. In one embodiment, RF front-end circuit 124 may down-convert a received RF signal to baseband and/or up-convert a baseband signal for RF transmission. RF front-end circuit 124 may employ any of a variety of architectures and circuit configurations, such as, for example, low-IF receiver circuitry, direct-conversion receiver circuitry, direct up-conversion transmitter circuitry, and/or offset-phase locked loop (OPLL) transmitter circuitry, as desired. RF front-end circuit 124 may additionally employ a low noise amplifier (LNA) for amplifying an RF signal received at antenna 130 and/or a power amplifier for amplifying a signal to be transmitted by antenna 130. In alternative embodiments, the power amplifier may be provided external to RF front-end circuit 124 (e.g., within RF interface 110).

Digital processing circuit 121 may provide a variety of signal processing functions, as desired, including baseband functionality. For example, in one embodiment, digital processing circuit 121 may be configured to perform filtering, decimation, modulation, demodulation, coding, decoding, correlation and/or signal scaling. In addition, digital processing circuit 121 may perform other digital processing functions, such as implementation of the communication protocol stack, control of audio testing, and/or control of user I/O operations and applications. To perform such functionality, digital processing circuit 121 may include various specific circuitry, such as a software programmable MCU and/or DSP, as well as a variety of specific peripheral circuits such as memory controllers, direct memory access (DMA) controllers, hardware accelerators, voice coder-decoders (CODECs), digital audio interfaces (DAI), UARTs (universal asynchronous receiver transmitters), and user interface circuitry. The choice of digital processing hardware (and firmware/software, if included) depends on the design and performance specifications for a given desired implementation, and may vary from embodiment to embodiment.

In addition, as shown in FIG. 1 regulator circuit 126 may provide a regulated supply voltage/current for circuits within RF front-end circuit 124 and/or digital processing circuit 121. Accordingly, regulator circuit 126 may be representative of a linear regulator and may include circuitry that allows regulator 126 to directly use battery voltage ($V_{Batt}$) as a supply voltage. More particularly, regulator circuit 126 may employ a stacked device and a dynamic bias circuit that may selectively provide either a fixed-percentage bias voltage or a regulated bias voltage that is at a fixed offset from the supply voltage for the stacked device. Further details regarding specific implementations of regulator circuit 126 will be provided below.

Figure 2:
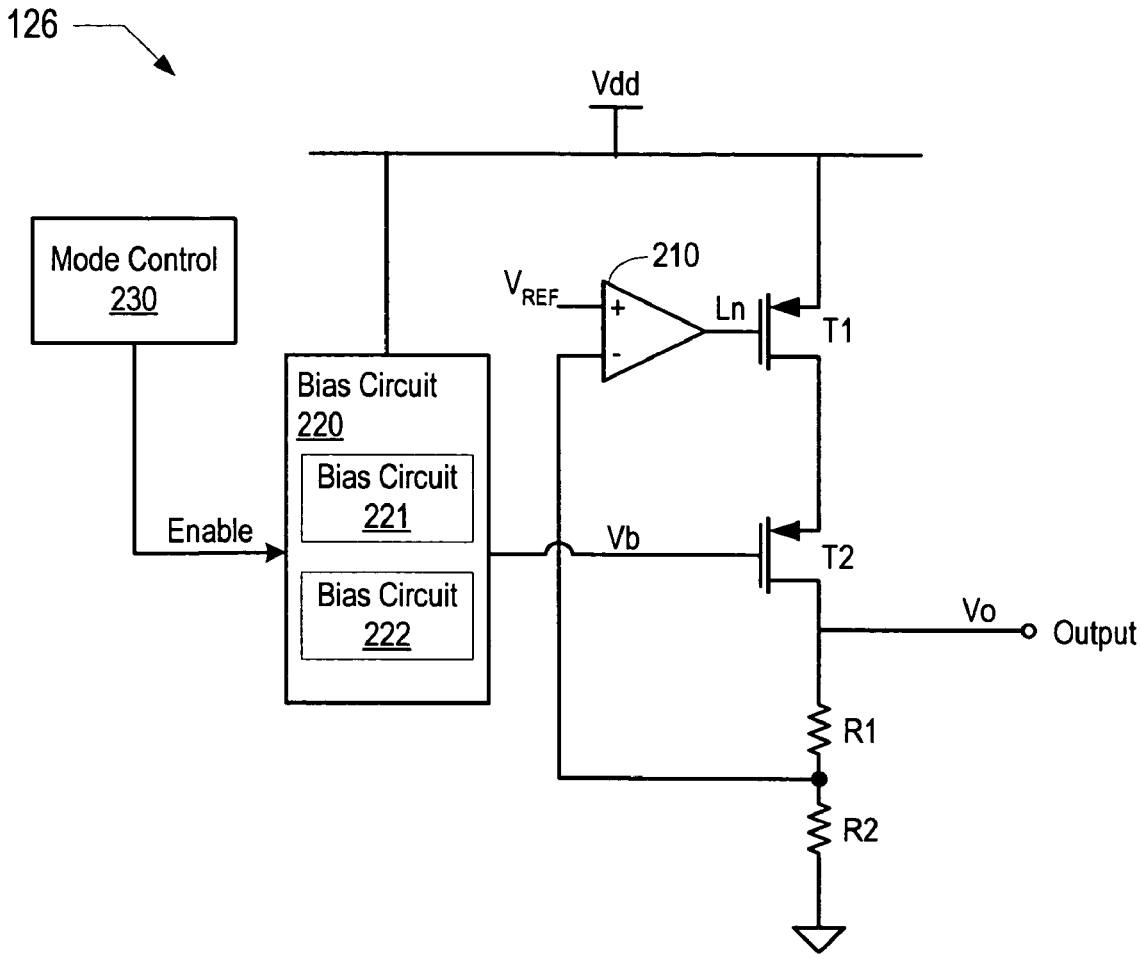
FIG. 2 is a diagram of one embodiment of the regulator circuit of FIG. 1 including a dynamic bias circuit.

Referring to FIG. 2, a diagram of one embodiment of regulator circuit 126 including a dynamic bias circuit of FIG. 1 is shown. Regulator circuit 126 includes two P-type metal oxide semiconductor (PMOS) transistors coupled in a cascode arrangement between Vdd and circuit ground (Gnd). The transistors are designated T1 and T2. The source of T1 is coupled to Vdd and the drain of T1 is coupled to the source of T2. The drain of T2 is coupled to one terminal of a resistor R1. The other terminal of R1 is coupled to one terminal of a resistor R2, while the other terminal of R2 is coupled to Gnd. The output of regulator circuit 126 (Vo) is the node between R1 and T2. The gate of T1 is coupled to the output (Ln) of an operational amplifier 210. The positive input of amplifier 210 is coupled to a reference voltage $V_{REF}$ and the negative input of amplifier 210 is coupled to the node between R1 and R2. The gate of T2 is coupled to the output (Vb) of a bias circuit 220. Bias circuit 220 is coupled to Vdd and to an enable signal provided by a mode control unit 230.

As described above, low-voltage CMOS devices may be damaged by excess supply voltage. Accordingly, one design approach for using low-voltage devices with higher supply voltages includes dividing the supply voltage between a stacked device and a circuit or core device to protect the circuit device. In one embodiment, Vdd may be directly derived from $V_{Batt}$. Accordingly, there may be a wide variation in the range of voltages of Vdd. At the upper end of the voltage range, low voltage CMOS devices may be damaged. Thus, in the illustrated embodiment, transistor T2 is a stacked device and T1 is the core device. As such, Vdd may be divided substantially equally between T1 and T2. Thus offering protection from voltage overstressing for the core device.

In FIG. 2, amplifier 210 is configured as part of an output stage of regulator circuit 126 and may provide a gate voltage (Ln) to the gate of T1 during operation. As such, the output voltage Vo may be expressed as $$Vo = V_{REF}\left(1 + \frac{R2}{R1}\right) \tag{1}$$

It is noted that regulator circuit 126 may be configured to provide a given amount of current at a given output voltage. Thus, the gate of T1 may be biased to create a suitable $V_{GS}$ that will allow the given current to flow through T1. In addition, since T2 is in series with T1, the gate of T2 may also be biased to create a suitable $V_{GS}$ that will allow the current flowing through T1 to also flow through T2.

In one embodiment, regulator circuit 126 may selectively operate in a low power mode and in a high power mode. In the low power mode such as in standby operation, for example, the demand for current supplied at the output node of regulator 126 may be low. In the high power mode, the demand for current may be much higher. For example, RF analog circuits within RF front end 124 may have a larger current demand during operations such as RF transmission.

Accordingly, in one embodiment, bias circuit 220 may selectively provide a bias voltage to the gate of T2 using a first bias circuit 221 or a second bias circuit 222 depending on a mode of operation of regulator circuit 126. For example, bias circuit 220 may selectively provide the bias voltage using bias circuit 221 if regulator circuit 126 is operating in low power mode, and provide the bias voltage using bias circuit 222 if regulator circuit 126 is operating in high power mode. As such, mode control 230 may provide the enable signal, which may select which bias circuit supplies the voltage to the gate of T2, to bias circuit 220 based upon the operating mode. It is noted that in other embodiments, other modes and corresponding bias voltage circuits are possible and contemplated.

As will be described in greater detail below in conjunction with the descriptions of FIG. 3 and FIG. 4, in the low power mode of operation, the bias voltage may be provided as a fixed (it is understood that the term "fixed" includes negligible variations) percentage of the supply voltage as the supply voltage varies using, for example, a simple resistor divider (e.g., bias circuit 221). However, since the supply voltage (e.g., Vdd) may correspond directly to the battery voltage $V_{Batt}$, when the battery voltage decreases, Vdd also decreases. A decrease in Vdd may cause a corresponding decrease in Vb and thus $V_{GS}$ of T2. Since the saturation current of T2 is proportional to $V_{GS}$, a decrease in $V_{GS}$ may cause the conduction current of T2 to decrease. Since current demand may be reduced in the low power mode, the resistor divider may be a suitable design choice for supplying the bias voltage to the gate of T2.

However, the resistor divider circuit alone may not suitable for use in the high power mode. Thus, to accommodate situations where $V_{Batt}$ may decrease, but regulator circuit 126 may need to provide high current such as during operation in the high power mode, bias circuit 220 may selectively provide the bias voltage using bias circuit 222. In this case, the bias voltage may be actively regulated to be at a fixed offset voltage away from the supply voltage as the supply voltage varies, thereby providing to T2, a suitable $V_{GS}$ for conducting high current.

Figure 3:
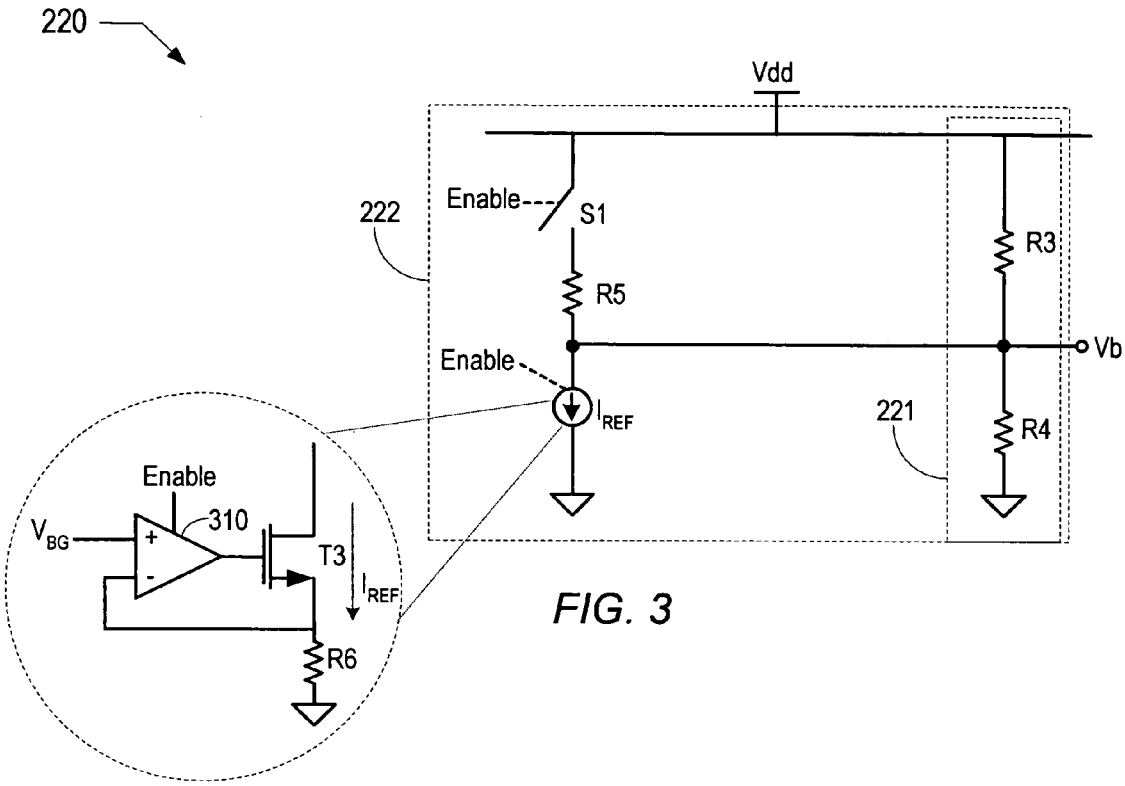
FIG. 3 is a diagram of one embodiment of the dynamic bias circuit of FIG. 2.

FIG. 3 is a diagram of one embodiment of the bias circuit 126 shown in FIG. 2. It is noted that components corresponding to those shown in FIG. 1 and FIG. 2 are numbered identically for clarity and simplicity. Referring collectively to FIG. 1 through FIG. 3, bias circuit 220 of FIG. 3 includes a resistor divider circuit 221 that includes resistors R3 and R4 coupled in series between Vdd and Gnd. Bias circuit 220 also includes a resistor R5 coupled in series with an independent current source $I_{REF}$, between Vdd and Gnd. The node between R5 and $I_{REF}$ is coupled to the node between R3 and R4 and is the output of bias circuit 220. In addition, a switch (S1) is coupled in series between R5 and Vdd.

In the illustrated embodiment, both $I_{REF}$ and S1 are controlled by the enable signal described above. More particularly, when the enable signal is active, S1 is closed and $I_{REF}$ is operational. When the enable signal is not active, S1 is open and $I_{REF}$ is non-operational. It is noted that the term "operational" may refer to $I_{REF}$ providing current and the term "non-operational" may refer to $I_{REF}$ not providing current. Thus, when the enable signal is not active, the bias circuit 221 (e.g., the resistor divider circuit including resistors R3 and R4) may provide the bias voltage as a fixed percentage of Vdd. Conversely, when the enable signal is active, the bias circuit 222 (e.g., the entire bias circuit 220 shown in FIG. 3) may provide the bias voltage as a voltage that is regulated to be a predetermined voltage away from Vdd.

It is noted that for discussion purposes, an active enable signal may be representative of a high logic level and an inactive enable signal may be representative of a low logic level. However, it is contemplated that in other embodiments, an active enable signal may be representative of a low logic level and an inactive enable signal may be representative of a high logic level.

In one embodiment, the independent current source $I_{REF}$ may be implemented using a bandgap reference circuit in which a bandgap voltage may be used as a reference voltage. As shown in the exploded view of $I_{REF}$, a non-inverting amplifier 310 may provide the gate voltage for transistor T3 when enabled using the enable input. As such, it is the bandgap voltage $V_{BG}$ that is used as a reference voltage and not Vdd or $V_{Batt}$. $I_{REF}$ may be expressed as $$I_{REF} = \frac{V_{BG}}{R6} \tag{2}$$

Accordingly, from Equation 2 it is shown that $I_{REF}$ may be substantially constant while Vdd may vary as described above.

It is noted that power consumption may be a design consideration, particularly in the low power mode. Thus in one embodiment, to reduce the current drawn by bias circuit 220 in the low power mode, R3 and R4 may have high resistance values that provide a high impedance to current. Specifically, the resistance value of R4 may be much higher than the resistance value of R5.

In the illustrated embodiment, when the enable signal is not active and S1 is open, Vb may be derived by the resistor divider circuit as shown in Equation 3 below.

$$Vb = \frac{R4}{R3 + R4} Vdd \tag{3}$$

As such, Vb may be a fixed portion (or percentage) of Vdd as Vdd varies.

Conversely, during operation in the high power mode, the enable signal is active. Thus S1 is closed and $I_{REF}$ is operational, and Vb may be derived from the combination of the resistor divider circuit and the current source circuit as shown below $$Vb = Vdd - (R5 \cdot I_{REF}) \text{ substituting for } I_{REF} \tag{4}$$

$$Vb = Vdd - \left(V_{BG}\frac{R5}{R6}\right). \tag{5}$$

Thus, Equations 4 and 5 show that Vb may decrease with decreases in Vdd, thus dynamically tracking Vdd by a predetermined offset amount. As shown, the predetermined offset amount corresponds to the voltage drop across R5 due to $I_{REF}$. As described above, the predetermined offset amount is based upon the bandgap reference voltage.

Further, since VGS may be expressed as $$V_{GS} = Vdd - Vb, \tag{6}$$

as Vdd decreases, the corresponding decrease in Vb may cause $V_{GS}$ to be maintained at a suitable value that will allow T2 to conduct a sufficient amount of current for proper circuit operation in the high power mode of operation.

In the illustrated embodiment, the impedance looking into the output node of bias circuit 220 may be substantially equal to the resistance value of R5 when the enable signal is active. To improve power consumption during operation in the high power mode, while maintaining a suitable impedance at the output of bias circuit 220, a buffer amplifier may be added to bias circuit 220. Accordingly, FIG. 4 is a diagram of another embodiment of the bias circuit 126 shown in FIG. 2, which includes an additional buffer amplifier circuit. Components that correspond to components shown in FIG. 1 through FIG. 3 are numbered identically for clarity and simplicity.

Figure 4:
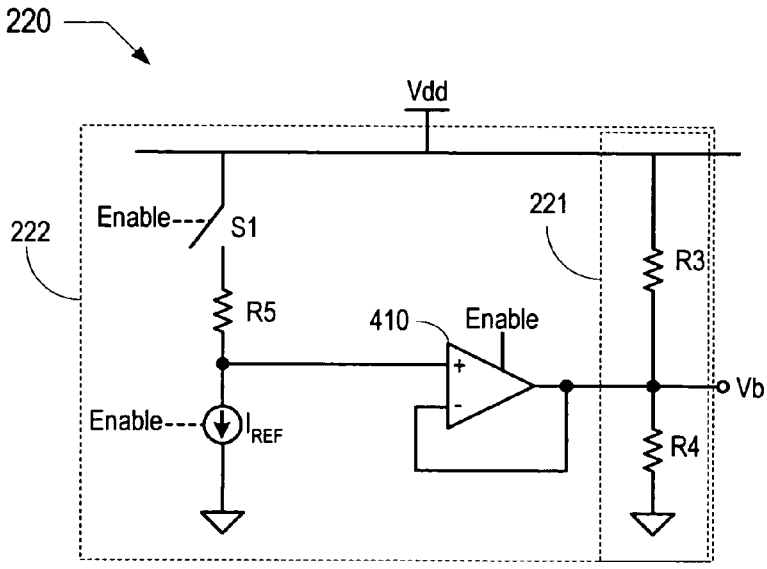
FIG. 4 is a diagram of another embodiment of the dynamic bias circuit of FIG. 2.

Referring collectively to FIG. 1 through FIG. 4, bias circuit 220 of FIG. 4 is similar to the bias circuit shown in FIG. 3. However, the bias circuit 220 of FIG. 4 includes a buffer amplifier circuit 410 that is coupled between the node between R5 and $I_{REF}$, and the node between R3 and R4. More particularly, the output of amplifier 410 is coupled to the node between R3 and R4 and the non-inverting input of amplifier 410 is coupled to the node between R5 and $I_{REF}$. The output of bias circuit 220 is at the node between R3 and R4.

In the illustrated embodiment, amplifier 410 is implemented as a unity gain amplifier as there is no component in the feedback loop. However, in other embodiments, other amplifier configurations may be used. Amplifier 410 also includes an enable input. As described above, the enable input may effectively turn amplifier 410 on and off. As shown, both $I_{REF}$ and S1 are also controlled by the enable signal as described above.

In one embodiment, during operation in the low power mode, bias circuit 221 of bias circuit 220 of FIG. 4 may provide a bias voltage that is a fixed portion of Vdd as Vdd varies, as shown in Equation 3 above. Conversely, during operation in the high power mode, bias circuit 222, which may include the entire bias circuit 220 of FIG. 4, may provide a regulated bias voltage at a predetermined offset voltage from the supply voltage as the supply voltage varies, thereby establishing a suitable $V_{GS}$ at T2 for conducting high current.

In one embodiment, the current source $I_{REF}$ may be implemented as described above in the description of FIG. 3. Thus, the voltage at the non-inverting input of amplifier 410 may be derived as shown in Equations 4 and 5. The impedance looking into the output node of bias circuit 220 may be the impedance looking into the output of amplifier 410, which may be designed significantly lower than the impedance looking into the node between R5 and $I_{REF}$ (e.g., value of R5) for the same total current consumption. Accordingly, R5 is irrelevant to the impedance of the output node and may be selected to have a larger resistance value than R5 of FIG. 3, and $I_{REF}$ may be implemented to provide a lower current value, while the circuit still provides a bias voltage Vb at the output of bias circuit 220 to establish a suitable $V_{GS}$ at T2 for conducting high current.

Although the embodiments above have been described in considerable detail, numerous variations and modifications will become apparent to those skilled in the art once the above disclosure is fully appreciated. It is intended that the following claims be interpreted to embrace all such variations and modifications.

What is claimed is:

1. A regulator circuit comprising:

a first transistor coupled to a supply voltage;

a second transistor coupled between the first transistor and an output node; and a bias circuit coupled to selectively provide a bias voltage to a gate of the second transistor;

wherein, during a first mode, the bias circuit is configured to provide the bias voltage at a fixed percentage of the supply voltage as the supply voltage varies; and wherein, during a second mode, the bias circuit is configured to provide the bias voltage at a fixed offset from the supply voltage as the supply voltage varies.

2. The regulator circuit as recited in claim 1, wherein the bias circuit comprises a first resistor coupled to a second resistor forming a voltage divider between the supply voltage and a reference node.

3. The regulator circuit as recited in claim 2, wherein the bias circuit further comprises a third resistor coupled to an independent current source, wherein one terminal of the third resistor is coupled to the supply voltage and one terminal of the independent current source is coupled to the reference node, wherein a node between the third resistor and the independent current source is coupled to the output node.

4. The regulator circuit as recited in claim 2, wherein the bias circuit is configured to provide the bias voltage at the fixed offset from the supply voltage in response to the independent current source being enabled by an enable signal.

5. The regulator circuit as recited in claim 3, wherein the bias circuit is configured to provide the bias voltage at the fixed percentage of the supply voltage in response to the independent current source being disabled by an enable signal.

6. The regulator circuit as recited in claim 3, wherein the independent current source provides a reference current dependent upon a bandgap reference voltage.

7. The regulator circuit as recited in claim 3, wherein the independent current source provides a reference current that is independent of variations in the supply voltage.

8. The regulator circuit as recited in claim 7, wherein the bias circuit further comprises a third resistor coupled to an independent current source, wherein one terminal of the third resistor is coupled to the supply voltage and one terminal of the independent current source is coupled to the reference node, wherein a node between the third resistor and the independent current source is coupled to an input of a buffer amplifier circuit, and wherein an output of the buffer amplifier circuit is coupled to the output node.

9. The regulator circuit as recited in claim 8, wherein the bias circuit is configured to provide the bias voltage at the fixed offset from the supply voltage in response to the independent current source and the buffer amplifier circuit being enabled by an enable signal.

10. The regulator circuit as recited in claim 8, wherein the bias circuit is configured to provide the bias voltage at the fixed percentage of the supply voltage in response to the independent current source and the buffer amplifier circuit being disabled by an enable signal.

11. The regulator circuit as recited in claim 8, wherein the independent current source provides a reference current dependent upon a bandgap reference voltage.

12. The regulator circuit as recited in claim 8, wherein the independent current source provides a reference current that is independent of variations in the supply voltage.

13. The regulator circuit as recited in claim 1, further comprising a linear circuit coupled to a gate of the first transistor, wherein the linear circuit is configured to provide a gate voltage sufficient to cause the first transistor to conduct current.

14. The regulator circuit as recited in claim 1, wherein the first mode comprises a low power mode of operation.

15. The regulator circuit as recited in claim 1, wherein the second mode comprises a high power mode of operation.

16. A regulator circuit comprising:

a first transistor coupled to a supply voltage;

a second transistor coupled between the first transistor and an output node; and a bias circuit coupled to selectively provide a bias voltage to a gate of the second transistor;

wherein, during a first mode, the bias voltage is derived from an output node of a resistor voltage divider circuit of the bias circuit; and wherein, during a second mode, the bias voltage is derived from an output node of a divider circuit, of the bias circuit, that includes an independent current source.

17. The regulator circuit as recited in claim 16, wherein during the first mode, the bias voltage comprises a voltage that is a fixed percentage of the supply voltage as the supply voltage varies.

18. The regulator circuit as recited in claim 17, wherein the bias circuit is configured to provide the bias voltage at the fixed percentage of the supply voltage in response to the independent current source being disabled by an enable signal.

19. The regulator circuit as recited in claim 16, wherein, during the second mode, the bias voltage comprises a voltage that is a fixed offset from the supply voltage as the supply voltage varies.

20. The regulator circuit as recited in claim 19, wherein the bias circuit is configured to provide the bias voltage at the fixed offset from the supply voltage in response to the independent current source being enabled by an enable signal.

21. The regulator circuit as recited in claim 16, wherein the independent current source provides a reference current dependent upon a bandgap reference voltage.

22. The regulator circuit as recited in claim 16, wherein the independent current source provides a reference current that is independent of variations in the supply voltage.

23. An integrated circuit for use in a wireless communication device, the integrated circuit comprising:

a radio frequency (RF) circuit; and a regulator circuit coupled to provide power to the RF circuit during operation in a low power mode and a high power mode;

wherein the regulator circuit includes:

a first transistor coupled to a supply voltage;

a second transistor coupled between the first transistor and an output node; and a bias circuit coupled to selectively provide a bias voltage to a gate of the second transistor;

wherein, during the low power mode, the bias circuit is configured to provide the bias voltage at a fixed percentage of the supply voltage as the supply voltage varies; and wherein, during the high power mode, the bias circuit is configured to provide the bias voltage at a fixed offset from the supply voltage as the supply voltage varies.

24. The integrated circuit as recited in claim 23, wherein the bias circuit includes a resistor voltage divider including a plurality of resistors, wherein the voltage divider is configured to provide the bias voltage at an output node between two resistors of the plurality of resistors.

25. The integrated circuit as recited in claim 24, wherein the bias circuit further comprises a resistor coupled to an independent current source, wherein one terminal of the resistor is coupled to the supply voltage and one terminal of the independent current source is coupled to the reference node, wherein a node between the third resistor and the independent current source is configured to provide the bias voltage to the output node.

26. The integrated circuit as recited in claim 25, wherein the independent current source provides a reference current dependent upon a bandgap reference voltage.

27. The integrated circuit as recited in claim 25, wherein the independent current source provides a reference current that is independent of variations in the supply voltage.

28. The integrated circuit as recited in claim 25, wherein the regulator circuit further includes a mode control unit configured to provide an active enable signal to the bias circuit in response to operating in the high power mode, and to provide an inactive enable signal in response to operating in the low power mode.

29. The integrated circuit as recited in claim 28, wherein the bias circuit is configured to provide the bias voltage at the fixed offset from the supply voltage in response to receiving the active enable signal, and wherein the bias circuit is configured to provide the bias voltage at the fixed percentage of the supply voltage in response to receiving the inactive enable signal.

30. The integrated circuit as recited in claim 29, wherein the bias circuit further comprises a buffer amplifier circuit, wherein a node between the third resistor and the independent current source is coupled to an input of the buffer amplifier circuit, and wherein an output of the buffer amplifier circuit is coupled to provide the bias voltage at the fixed offset from the supply voltage to the output node in response receiving the active enable signal.

* * * * *